US007739847B2

(12) United States Patent
Griman

(10) Patent No.: US 7,739,847 B2
(45) Date of Patent: Jun. 22, 2010

(54) WIND RESISTANT SIDING PANEL

(75) Inventor: George A. Griman, Troy, OH (US)

(73) Assignee: Alcoa Home Exteriors, Inc., Pittsburgh, PA (US)

( * ) Notice: Subject to any disclaimer, the term of this patent is extended or adjusted under 35 U.S.C. 154(b) by 940 days.

(21) Appl. No.: 10/833,785

(22) Filed: Apr. 28, 2004

(65) Prior Publication Data

US 2005/0252138 A1 Nov. 17, 2005

(51) Int. Cl.
*E04D 1/00* (2006.01)

(52) U.S. Cl. ..... 52/519; 52/748.1; 52/478; 52/546

(58) Field of Classification Search ..... 52/748.1, 52/748.11, 545, 519, 520, 548, 521, 539, 52/529, 549, 553, 557, 528, 543, 547, 478
See application file for complete search history.

(56) References Cited

U.S. PATENT DOCUMENTS 2,124,830 A * 7/1938 Roth ..... 52/521
3,458,962 A * 8/1969 Kendall ..... 52/309.1
4,102,106 A * 7/1978 Golder et al. ..... 52/533
4,580,383 A 4/1986 Pittman et al.
4,720,955 A 1/1988 Kane
6,363,676 B1 * 4/2002 Martion, III ..... 52/519
6,370,832 B1 4/2002 McGarry et al.
2002/0092256 A1 7/2002 Hendrickson et al.
2003/0131552 A1 * 7/2003 Leichtfried ..... 52/543

* cited by examiner

*Primary Examiner*—Richard E Chilcot, Jr.
*Assistant Examiner*—William V Gilbert
(74) *Attorney, Agent, or Firm*—Lathrop & Gage LLP

(57) ABSTRACT

An improved siding panel has a fastening hem that includes an engagement member structured to extend outwardly from a building when the siding panel is mounted to the building. The engagement member is generally trapezoid-shaped in cross section and includes a first leg, a second leg, and an apex portion disposed therebetween, with spaced elongated openings being formed in the apex portion. The siding panel is cooperable with a fastener having an elongated shank and a head to mount the siding panel to the building. The siding panel is mounted to the building by receiving the shank through one of the openings. During certain wind loading, the apex portion is engageable with the head, which thereby deflects the first and second legs from a relaxed position to a deflected position where the edges of the opening can engage the shank of the fastener to provide a greater resistance to wind loading.

10 Claims, 2 Drawing Sheets

WIND RESISTANT SIDING PANEL

BACKGROUND OF THE INVENTION

1. Field of the Invention

The invention relates generally to siding for a building and, more particularly, to a siding panel configured to resist wind loading.

2. Description of the Related Art

Numerous exterior treatment systems are known for use with buildings and the like. Among such exterior treatment systems are siding, such as vinyl and aluminum siding, as well as other known treatment systems.

Vinyl siding is particularly advantageous for a number of reasons. For instance, it is relatively inexpensive and is relatively simple to install. It has an extremely long service life, requires virtually no maintenance, and is available in numerous colors and textures, and it can be configured to have numerous different types of appearance.

Vinyl siding typically includes a plurality of siding panels that interlock with one another, and each such siding panel is mounted to a building with a number of fasteners such as nails, staples, and the like that are fasteningly received through a fastening hem on each siding panel. The fastening hem of a siding panel typically extends along one elongated side of the siding panel. The other side of the siding panel, i.e., the side opposite the fastening hem, typically is interlocked in some fashion with an adjacent siding panel. Accordingly, siding panels typically are installed with a relatively small quantity of fasteners. While vinyl siding has typically been effective for its intended purpose, vinyl siding has not, however, been without limitations.

Vinyl siding sometimes can be subjected to extreme wind loading, such as during inclement weather. Different regions of the country, typically have particular requirements that must be met by siding employed in that area, and a typical requirement is a wind loading rating. That is, siding must be able to withstand a certain wind load without becoming detached from the building. It thus would be desirable to provide an improved siding panel that has a relatively greater resistance to wind loading than other similar panels.

SUMMARY OF THE INVENTION

An improved siding panel has a fastening hem that includes an engagement member which is structured to extend outwardly from a building when the siding panel is mounted to the building. The engagement member is generally trapezoid-shaped in cross section and includes a first leg, a second leg, and an apex portion disposed therebetween, with spaced elongated openings being formed in the apex portion. The siding panel is cooperable with a fastener having an elongated shank and a head to mount the siding panel to a building. The siding panel is mounted to the building by receiving the shank through one of the openings. During certain wind loading, the apex portion is engageable with the head, which thereby deflects the first and second legs from a relaxed position to a deflected position where the edges of the opening can engage the shank of the fastener to provide a greater resistance to wind loading.

Accordingly, an aspect of the invention is to provide an improved siding panel that is configured to resist wind loading.

Another aspect of the invention is to provide an improved elongated siding panel structured to be mounted to a building with at least a first fastener, the fastener having a head and an elongated shank, the siding panel being structured to resist wind loading, wherein the general nature of the siding panel can be stated as including a body and an adjacent fastening hem. The fastening hem includes a base member and an engagement member, with the engagement member protruding outwardly from the base member and being structured to extend away from the building when the siding panel is mounted to the building. The engagement member includes a first leg, a second leg, and an apex portion extending between the first and second legs. The apex portion includes a number of relationally spaced elongated openings formed therein. The engagement member includes a number of pairs of elongated edges disposed adjacent the openings. The openings are structured to receive at least a portion of the shank therethrough when the panel is mounted to the building. The portions of the first and second legs adjacent the openings are movable between a relaxed position wherein the edges of a pair of edges are substantially disengaged from the shank and a deflected position wherein at least a portion of the edges of the pair of edges are engaged with the fastener. The engagement member is structured to be engageable with the head of the fastener during certain wind loading to move the first and second legs from the relaxed position toward the deflected position to resist the wind loading.

BRIEF DESCRIPTION OF THE DRAWINGS

A further understanding of the invention can be gained from the following description of the Preferred Embodiment when read in conjunction with the accompanying drawings in which.

Similar numerals refer to similar parts throughout the Specification.

DETAILED DESCRIPTION OF PREFERRED EMBODIMENTS

Figure 1:
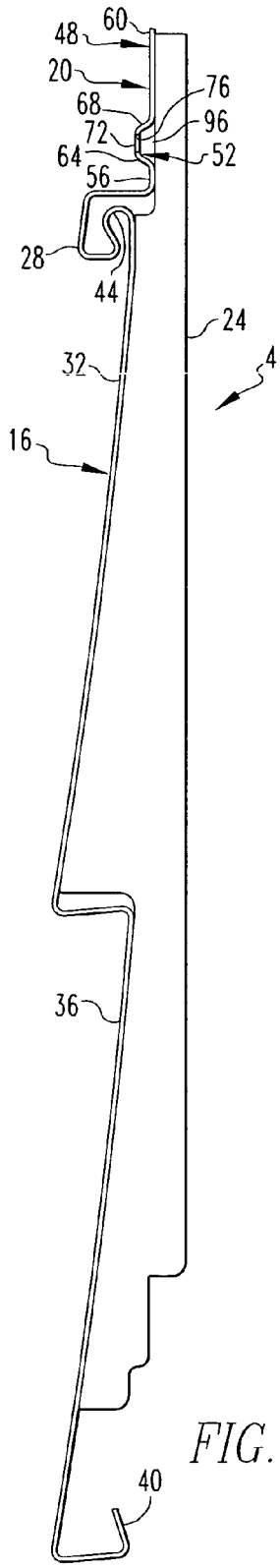
FIG. 1 is a side elevational view of an improved siding panel in accordance with the invention.

An improved siding panel 4 in accordance with the invention is indicated generally in FIG. 1. The improved siding panel 4, is, as will set forth in greater detail below, configured to provide a greater degree of resistance to wind loading than is provided by similar siding panels. As can be understood from FIGS. 3 and 4, the siding panel 4 is mountable to a building 8 with a number of fasteners 12. As used herein, the expression "a number of" and variations thereof shall refer broadly to any non-zero quantity, including a quantity of one.

As can be best understood from FIG. 1, the improved siding panel 4 includes a body 16 and an adjacent fastening hem 20. The exemplary siding panel 4 that is depicted herein additionally includes a backer portion 24 which, when the siding panel 4 is mounted to the building 8, will be disposed adjacent the building 8. The backer portion 24 can be provided for any of a variety of reasons and may be made of a number of materials, such as insulative materials and/or stiffening materials, and the like.

The body 16 includes a lock 28, a first course 32, a second course 36, and a tab 40. The lock 28 is disposed near the fastening hem 20 and is configured to be cooperable with an adjacent siding panel 4 (not expressly depicted herein) to connect together the two siding panels 4. The first course 32 and the second course 36 are, in the depicted exemplary embodiment, intended to each simulate a course of clapboard siding. The second course 36 terminates at the tab 40. The lock 28 includes a receptacle 44 formed therein, and the tab 40 of an adjacent siding panel 4 is receivable in the receptacle 44 in order to connect together the two adjacent siding panels 4.

The fastening hem 20 includes a base member 48 and an engagement member 52. The base member 48 includes a substantially planar first portion 56 and a substantially planar second portion 60. The first portion 56 is adjacent the body 16. The engagement member 52 extends between the first portion 56 and the second portion 60. The engagement member 52 protrudes outwardly from the base number 48 and, as can be understood from FIGS. 3 and 4, extends in a direction generally away from the building 8 when the siding panel 4 is mounted to the building 8.

As can further be understood from FIG. 1, the engagement member 52 is generally of a trapezoid shape in cross section and includes a first leg 64, a second leg 68, and an apex portion 72. The apex portion 72 is disposed between the first leg 64 and the second leg 68 and, in the depicted exemplary embodiment, is oriented substantially parallel with the base member 48. The transitions between the first and second legs 64 and 68 and each of the base member 48 and the apex portion 72 are radiused. The first and second legs 64 and 68, i.e., the straight portions thereof, are each oriented at an angle in the range of about 50° to 70° with respect to the base member 48 and may be oriented at an angle of about 60° with respect to the base member 48. The first leg 64 extends away from the first portion 56 toward the apex portion 72, and the second leg 68 extends from the second portion 60 toward the apex portion. As the first and second legs 64 and 68 extend away from the first and second portions 56 and 60, respectively, the first and second legs 64 and 68 also extend generally toward one another.

Figure 2:
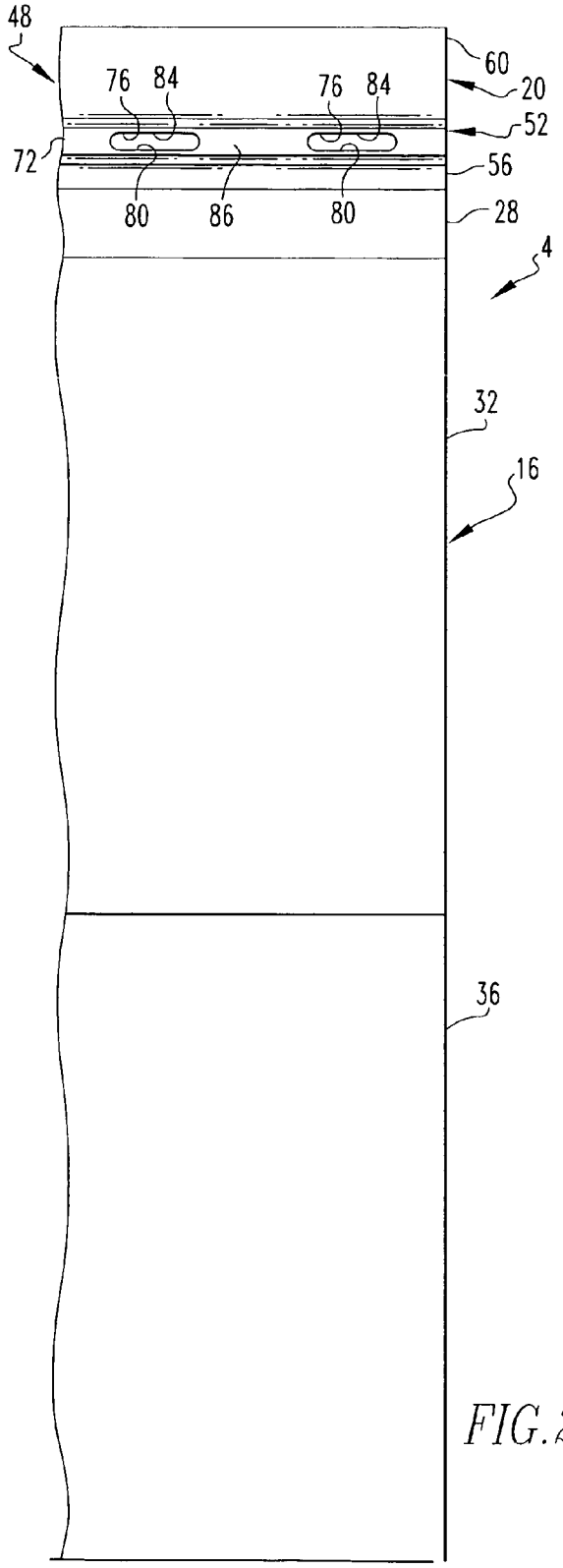
FIG. 2 is a front elevational view of a portion of the siding panel of FIG. 1.

As can be understood from FIG. 2, the apex portion 72 includes a number of relationally spaced elongated openings 76 formed therein. In the depicted exemplary embodiment, the elongated openings 76 are oriented substantially parallel with the longitudinal extent of the siding panel 4 and are longitudinally aligned with one another. Each opening 76 includes a pair of parallel and confronting edges 80 and 84 which are disposed adjacent the openings 76. The apex portion 72 includes webs 86 between the openings 76, and the webs 86 each extend generally between the first and second legs 64 and 68.

In the depicted exemplary embodiment, the pair of edges 80 and 84 of any given opening 76 are disposed within the radiused transition between the apex portion 72 and either of the first leg 64 and the second leg 68. It is understood that the openings 76 can be configured in different fashions to provide the edges 80 and 84 at different locations within the engagement member 52 than are expressly depicted herein without departing from the concept of the invention.

Figure 4:
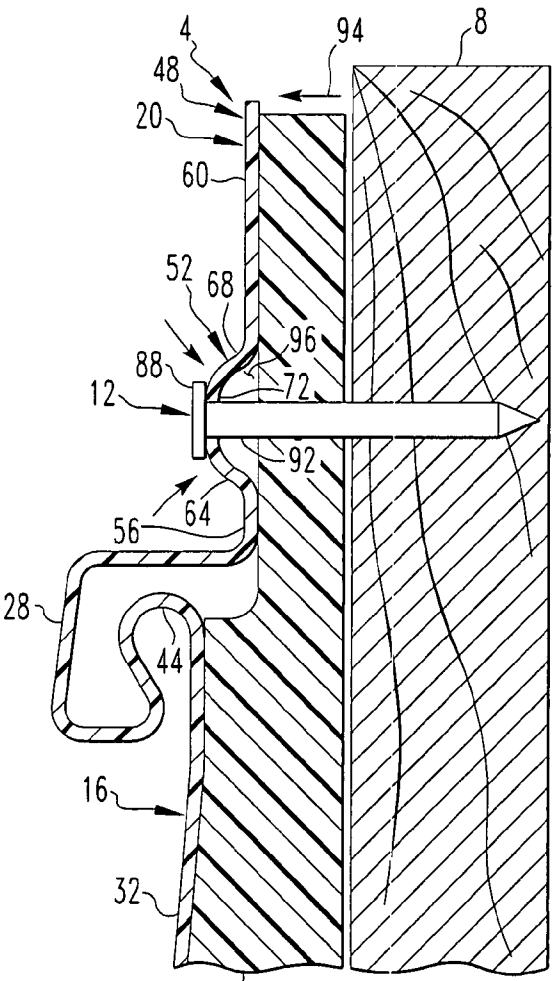
FIG. 4 is a view similar to FIG. 3, except depicting the siding panel subjected to wind loading period.
Figure 3:
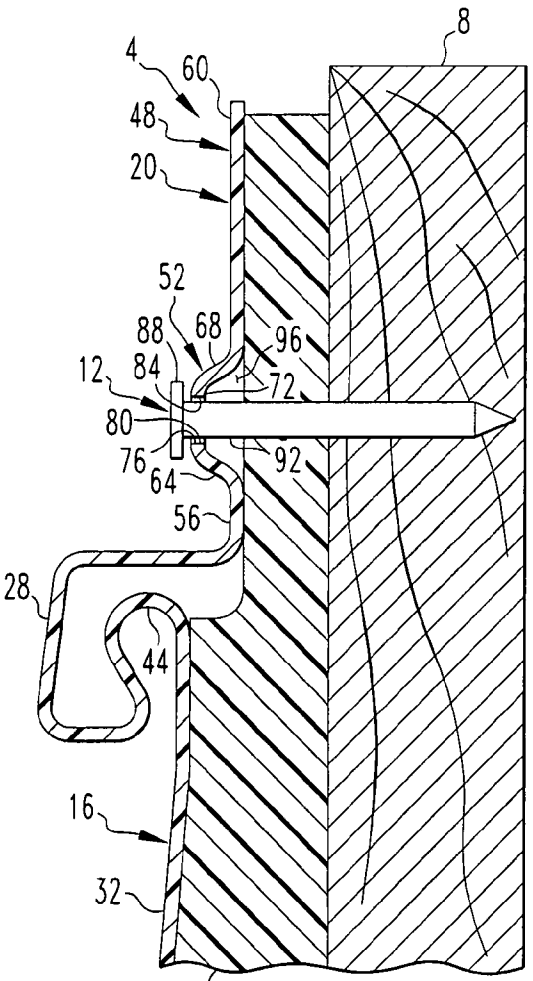
FIG. 3 is a side elevational view of a portion of the siding panel of FIG. 1 mounted to a building.

As can be understood from FIGS. 3 and 4, the exemplary fastener 12 includes a flared head 88 and an elongated shank 92. The exemplary fastener 12 is depicted as being a nail, but it is understood that other fasteners such as staples, screws, and the like can be employed without departing from the concept of the invention.

When the siding panel 4 is initially mounted to the building 8, the shank 92 is received through one of the openings 76 and is received in a portion of the building 8. The head 88 typically is spaced slightly from the apex portion 72 to enable longitudinal growth and shrinkage as a result of thermal expansion and contraction of the siding panel 4. However, the head 88 need not be spaced from the apex portion 72 in order to provide the beneficial aspects of the invention.

In accordance with an aspect of the invention, the portions of the first leg 64 and the second leg 68 that are adjacent the shank 92 are elastically movable between a relaxed position i.e., FIG. 3, and a deflected position, i.e., FIG. 4. In the relaxed position, the edges 80 and 84 of the opening 76 are not engaged with the shank 92. The first and second legs 64 and 68 typically are in the relaxed position in the absence of wind loading on the siding panel 4.

When the first and second legs 64 and 68 are moved to the deflected position, however, as is depicted in FIG. 4, and as is encountered during wind loading, the portions of the parallel pair edges 80 and 84 that are adjacent the shank become frictionally engaged with the shank 92 to provide a relatively greater degree of wind loading by resisting the siding panel 4 from being dislodged from the fastener 12 and thus from the building 8. More specifically, during wind loading the siding panel 4 will tend to move away from the building 8 in generally the direction of the arrow 94. Once the wind loading reaches a certain level, the apex portion 72 becomes engaged with the head 88 of the fastener 12 and deflects the first and second legs 64 and 68 from the relaxed position toward the deflected position until the edges 80 and 84 of one of the openings 76 engage the shank 92. In such condition the first and second legs 64 and 68 typically will also be engaged with the head 88 of the fastener 12. The frictional engagement of the edges 80 and 84 with the shank 92, as well as the frictional engagement of the first and second legs 64 and 68 with the head 88, frictional resist further movement of the siding panel 4 away from the building 8 in the general direction of the arrow 94, which provides resistance to wind loading.

It can further be seen that the openings 76 are spaced away from the base member 48 and thus from the building 8, which facilitates an installer being able to clearly see the openings 76 during installation of the siding panel 4. The trapezoid-shaped configuration of the engagement member 52 results in a void region 96 that is disposed between the first and second portions 56 and 60. The engagement member 52 can be provided during formation of the siding panel 4 by providing additional tooling to form the engagement member 52 in the fastening hem. The depicted configuration of the engagement member 52 thus is relatively inexpensive to incorporate and does not meaningfully increase the size or weight of the siding panel 4, which is advantageous. The improved siding panel 4 with the improved fastening hem 20 having the engagement member 52 thus provides a greater degree of resistance to wind loading than similar siding panels.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

Having described the presently preferred embodiments, it is to be understood that the invention may be otherwise embodied within the scope of the appended claims.

What is claimed is:

1. An elongated siding panel for mounting to a building with at least one fastener, the at least one fastener having a head and an elongated shank, the siding panel being structured to resist wind loading, the siding panel comprising:

a body of a first course of a siding panel;

a lock with a receptacle being open in a downward direction when mounted, the receptacle for receiving a tab of a second course of a siding panel mounted to the building above the first course of a siding panel, the engagement member further extending into an adjacent fastening hem; and the fastening hem including a base member and an engagement member the engagement member extending outwardly from the base member and away from the building when the siding panel is mounted to the building, the engagement member including a first leg, a second leg, and an apex portion, the apex portion extending between the first and second legs, the apex portion including a number of relationally spaced elongated openings formed therein, the elongated openings including oppositely disposed elongated edges, the openings being structured to receive at least a portion of the shank therethrough when the panel is mounted to the building, the apex portion is oriented generally parallel with the base member, the base member includes a substantially planar first portion and as substantially planar second portion, the first portion connecting the engagement member to the body, and the engagement member extending between the first and second portions, the first leg extends between the first portion and the apex portion, the second leg extending between the second portion and the apex portion, the apex portion being oriented generally parallel with the first and second portions, the second portion having a distal edge with respect to the second leg, the distal edge defining an uppermost extremity of the panel when mounted, the engagement member being structured to be engageable with the head of the fastener.

2. The siding panel of claim 1 wherein the engagement member is structured to be engageable with the head of the fastener during said certain wind loading to engage at least a portion of the oppositely disposed elongated edges with the shank of the fastener to resist the wind loading.

3. The siding panel of claim 1 wherein at least a portion of the oppositely disposed elongated edges move generally toward one another when the first and second legs are moved from the relaxed position toward the deflected position.

4. The siding panel of claim 1 wherein the first and second legs are oriented at an angle of about 50 degrees to 70 degrees with respect to the base member.

5. The siding panel of claim 1 wherein at least a portion of the oppositely disposed elongated edges extend substantially parallel with the shank when the first and second legs are in the relaxed position.

6. The siding panel of claim 1 wherein the apex portion includes a number of webs, the webs being disposed between the openings and extending between the first leg and the second leg.

7. The siding panel of claim 1 wherein the first leg extends away from the first portion at an angle of about 50 degrees to 70 degrees with respect to the first portion, the second leg extending away from the second portion at an angle of about 50 degrees to 70 degrees with respect to the second portion, the first and second legs extending away from the first and second portions, respectively, and generally toward one another.

8. The siding panel of claim 1 wherein the apex portion is structured to be spaced from the building when the siding panel is mounted to the building.

9. The siding panel of claim 1 wherein the engagement member is generally trapezoid-shaped.

10. The siding panel of claim 1 wherein the engagement member is continuous with the base member.

* * * * *